US008431300B2

(12) United States Patent
Kuramashi

(10) Patent No.: US 8,431,300 B2
(45) Date of Patent: Apr. 30, 2013

(54) TONER FOR ELECTROPHOTOGRAPHY AND DEVELOPER

(75) Inventor: Koji Kuramashi, Osaka (JP)

(73) Assignee: Kyocera Mita Corporation (JP)

( * ) Notice: Subject to any disclaimer, the term of this patent is extended or adjusted under 35 U.S.C. 154(b) by 364 days.

(21) Appl. No.: 12/906,172

(22) Filed: Oct. 18, 2010

(65) Prior Publication Data

US 2011/0091800 A1 Apr. 21, 2011

(30) Foreign Application Priority Data

Oct. 19, 2009 (JP) ..... 2009-240144

(51) Int. Cl.
*G03G 9/00* (2006.01)

(52) U.S. Cl.
USPC ..... 430/108.6; 430/108.1; 430/108.7; 430/108.8

(58) Field of Classification Search ..... 430/108.1, 430/108.6, 108.7, 108.8, 109.1, 110.1
See application file for complete search history.

(56) References Cited

U.S. PATENT DOCUMENTS

2004/0091800 A1* 5/2004 Yoshino et al. ..... 430/45
2007/0048651 A1* 3/2007 Nakamura ..... 430/111.33

FOREIGN PATENT DOCUMENTS

| | | |
|---|---|---|
| JP | 63-285555 | 11/1988 |
| JP | 2-140757 | 5/1990 |
| JP | 02-201452 | 8/1990 |
| JP | 2001-249486 | 9/2001 |
| JP | 2001-305816 | 11/2001 |
| JP | 2009-69531 | 4/2009 |

* cited by examiner

*Primary Examiner* — Stewart Fraser
(74) *Attorney, Agent, or Firm* — Gerald E. Hespos; Michael J. Porco; Matthew T. Hespos

(57) ABSTRACT

Toner for electrophotography contains toner base particles containing a binder resin, a colorant, and a wax, resin particles containing a binder resin and a wax, but substantially not containing a colorant, and an external additive that is externally added to the toner base particles and the resin particles, with a mean domain diameter of the wax in the resin particles being larger than a mean domain diameter of the wax in the toner base particles.

6 Claims, 3 Drawing Sheets

TONER FOR ELECTROPHOTOGRAPHY AND DEVELOPER

BACKGROUND OF THE INVENTION

1. Field of the Invention

The present disclosure relates to toner for electrophotography and developer containing the toner for electorophotography.

2. Description of the Related Art

An electrophotographic image forming apparatus such as a copier, a printer, a facsimile machine, and a multifunction peripheral of these, includes an image bearing member, a charging device that uniformly charges a surface of the image bearing member, an exposure device that forms an electrostatic latent image on the surface of the image bearing member by exposing the charged surface of the image bearing member based on image data, a developing device that develops the electrostatic latent image as a toner image by supplying toner to the surface of the image bearing member on which the electrostatic latent image has been formed, and a transfer device that transfer the toner constituting the toner image from the image bearing member to a recording medium. Using the aforementioned devices, the image forming apparatus transfers the toner image, which has been formed based on image data, to the recording medium, then forms an image on the recording medium by fixing the toner image onto the recording medium.

There is an increasing use of image forming apparatuses that not only perform monochrome printing, but are provided with a color printing function for forming color images. Specifically, image forming apparatuses such as single drum system color copiers and multifunction peripherals (MFPs) constituted by a single photosensitive drum are being used for example. However, when performing color printing on a single sheet with a single drum system image forming apparatus such as those, it is necessary to form an image on the photosensitive drum, which is the image bearing member, each time each color such as black, yellow, cyan, and magenta is to be developed on the paper. Accordingly, there is a problem that the printing speed when carrying out color printing drops to approximately one-quarter compared to the printing speed when carrying out monochrome printing. That is, there is a problem that color printing requires approximately four times the time compared to monochrome printing. Thus, shorter printing times, that is, faster printing speeds, are required for image forming apparatuses provided with a color printing function. Tandem system color image forming apparatuses and the like are put forth to satisfy these demands.

Specifically, for example, a tandem system color image forming apparatus is an image forming apparatus provided with an intermediate transfer belt for performing secondary transfer of a toner image to a transfer material such as paper after the toner image formed on the image bearing member has undergone primary transfer using an electrophotographic method, and forms a color image by superimposing multiple color toner images such as yellow (Y), magenta (M), cyan (C), and black (K) on the intermediate transfer belt. Image forming units corresponding to each color are provided in a row along the intermediate transfer belt in tandem system color image forming apparatuses for superimposing the toner images of multiple colors. Then, the toner images of the four colors YMCK formed by the photosensitive drum in each of the image forming units are transferred sequentially (primary transfer) so as to be superimposed over each other on intermediate transfer belt, thereby forming a color image. Then, the color image that is formed on the intermediate transfer belt is transferred (secondary transfer) onto the transfer material such as paper by a secondary transfer roller, which is arranged facing the intermediate transfer belt. In this way, a toner image corresponding to each color is formed on its respective image bearing member in each image forming unit, then these toner images are superimposed to form a color image, such that a tandem system color image forming apparatus achieves high speed printing. Here, a high-speed, low-temperature fixing process is used to fix the toner images onto the transfer material (a recording medium) also to achieve high speed printing.

On the other hand, to form high quality images, superior capabilities such as the following for example are required in the image forming apparatuses. First, superior toner color-producing qualities are required in the toner images (image) to be formed so as to achieve an image of high reproducibility based on the image data. Next, it is required to achieve high surface smoothness in the toner images (image) to be formed on the recording medium. By doing this, diffused reflection of light by the image surface is suppressed, and photo images and the like can be formed with high quality. Further still, superior fixing qualities are required. When there are superior fixing qualities over a long period, occurrences of an offset phenomenon or the like caused by the toner images adhering to the fixing rollers can be suppressed even though the images are formed repetitively, which may also contribute to improved smoothness in the image surface.

Thus, toner such as the following has been tested as toner to be used in the image forming apparatuses.

First, as a first example, toner was tested containing types of wax constituted by fatty acid ester, low melting point hydrocarbon, and high melting point hydrocarbon, having different endothermic peaks measured by DSC.

With this example, it is anticipated that no offset phenomenon will occur regardless of fixing conditions such as low temperature fixing or high temperature fixing due to the toner containing three types of waxes of different thermal characteristics. Further still, it is anticipated that occurrences of heat roller soiling will not occur even during long period usage and fixing qualities are superior using heavy papers also to which the fixing load tends not to be transmitted.

Furthermore, as a second example, an electrophotographic full color toner kit was tested constituted by a coloring toner, which is constituted by at least yellow toner, magenta toner, and cyan toner, and a colorless toner containing a release substance (wax) at 10 to 90 wt %.

With this example, it is anticipated that a toner kit can be provided that has color reproducibility, color mixing qualities, and transparency qualities due to a colorless toner being developed on the entire surface after the coloring toners of four colors have been developed, and further still that fixing offset can be prevented without coating a release agent on the fixing rollers.

Furthermore, methods such as the following have been tested as image forming methods using the image forming apparatuses.

As an example of the image forming methods, a multicolor image forming method has been tested in which, in a multicolor image forming method having a process in which multiple colored toner layers are fixed onto a transfer material (recording medium) as an image, and further having a process in which a transparent toner layer is fixed in an image area and a non-image area, and a surface mean roughness Ra and a maximum surface roughness Rmax of the fixed layers are set to predetermined surface roughnesses.

With this example, by having a process in which a transparent toner layer is fixed in an image area and a non-image area, and setting the surface mean roughness Ra and the maximum surface roughness Rmax of the fixed layers to predetermined surface roughnesses, it is anticipated that it will be possible to eliminate or suppress optical dispersion by the image surface, and to uniformly form a smooth high quality multicolor image, which has an appropriate gloss, excellent granularity, and high color tone, on the transfer material regardless of image type.

SUMMARY OF THE INVENTION

An object of the present disclosure is to provide toner for electrophotography that is superior in all of toner color-producing qualities, image surface smoothness, and fixing qualities without complicating a configuration of an image forming apparatus to which it is to be applied, and further still that is capable of suppressing occurrences of fogging. Furthermore, another object of the present disclosure is to provide a developer that contains the toner for electrophotography.

An aspect of the present disclosure that achieves this object is toner for electrophotography that contains: toner base particles containing a binder resin, a colorant, and a wax; resin particles containing a binder resin and a wax, but substantially not containing a colorant; and an external additive that is externally added to the toner base particles and the resin particles; wherein a mean domain diameter of the wax in the resin particles is larger than a mean domain diameter of the wax in the toner base particles.

Furthermore, another aspect of the present disclosure is developer that contains the toner for electrophotography and carrier.

DETAILED DESCRIPTION OF THE PREFERRED EMBODIMENTS

Figure 1:
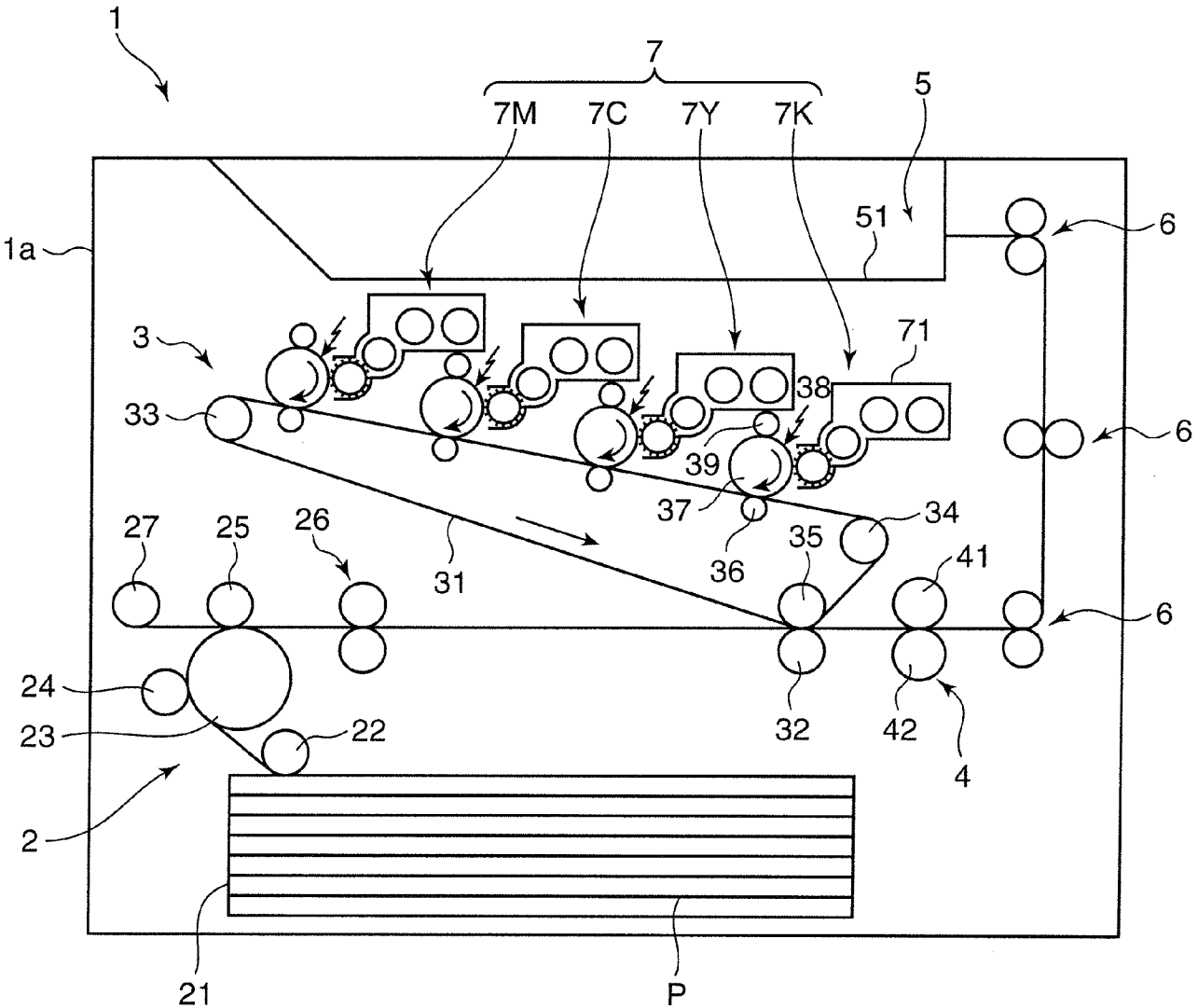
FIG. 1 is an outline cross-sectional view showing an overall configuration of a color printer 1 in which toner for electrophotography according to a present embodiment of the present disclosure is applied.

According to testing by the present inventor, with toner containing three types of waxes having different thermal characteristics such as the first example, it was difficult to achieve all of superior toner color-producing qualities, image surface smoothness, and fixing qualities even if the dispersion state and content ratio and the like of the raw materials of the toner were varied when manufacturing the toner, and moreover it was difficult to suppress occurrences of fogging.

Specifically, first, if fine dispersion is carried out in which the dispersion qualities of colorants such as pigments and the like are improved, the fixing qualities tend to decrease even if the toner color-producing qualities are improved.

This was inferred to be due to that, when fine dispersion is carried out to improve the dispersion qualities of colorants, not only are the dispersion qualities of the colorants improved, but the dispersion qualities of the wax are also improved, which reduces the domain diameter of the wax, thereby reducing the effect of adding wax.

Due to this reduction in fixing qualities, it becomes difficult to suppress occurrences of the offset phenomenon described above, and the image surface smoothness tends to decrease. And in a case of an image forming apparatus using a high-speed, low-temperature fixing process capable of achieving high speed printing, for example, using a tandem system color image forming apparatus, problems caused by this reduction in fixing qualities tend to become particularly conspicuous.

On the other hand, when the dispersion qualities of the toner raw materials are reduced and the content amount of wax is increased, the fixing qualities are improved and it is considered that sufficiently high fixing qualities can be achieved even in a case where the tandem system color image forming apparatus is used for example. However, even when the fixing qualities are improved by reducing the dispersion qualities of the toner raw materials and increasing the content amount of wax, the toner color-producing qualities are reduced and sufficient image density cannot be obtained, and moreover fogging tends to occur more easily.

Furthermore, also in a case where coloring toners of four colors are developed, it is necessary to have five developing devices provided in the image forming apparatus to use a toner kit as in the second example. That is, a developing device is required additionally to perform development using the colorless toner that is not directly involved in image forming. For this reason, there is a problem that the image forming apparatus has a configuration that is more complex than necessary.

Furthermore, in a same manner as the case of the second example where the toner kit is used, in the case of the example of the method, a developing device is required additionally to form a toner layer that is not directly related to image forming, and there is a problem that the image forming apparatus has a configuration that is more complex than necessary.

In light of these circumstances, an object of the present disclosure is to provide toner for electrophotography that is superior in all of toner color-producing qualities, image surface smoothness, and fixing qualities without complicating a configuration of an image forming apparatus to which the toner is to be applied, and further still that is capable of suppressing occurrences of fogging. Furthermore, another object is to provide developer that contains the toner for electrophotography.

Hereinafter, description is given regarding embodiments according to the present disclosure, but the present disclosure is not limited to these.

[Toner for Electrophotography]

Toner for electrophotography (hereinafter sometimes simply referred to as "toner") according to one embodiment of the present disclosure contains toner base particles containing a binder resin, a colorant, and a wax; resin particles containing a binder resin and a wax, but substantially not containing a colorant; and an external additive that is externally added to the toner base particles and the resin particles; and a mean domain diameter of the wax in the resin particles is larger than a mean domain diameter of the wax in the toner base particles.

Such toner for electrophotography is superior in all of toner color-producing qualities, image surface smoothness, and fixing qualities without complicating the configuration of the image forming apparatus to which the toner is to be applied, and further still is capable of suppressing occurrences of fogging.

The following is considered to be a reason for this.

First, the mean domain diameter of the wax of the resin particles that are not directly involved in image forming is larger than the mean domain diameter of the wax of the toner base particles that are directly involved in image forming. Since the mean domain diameter of the wax of the resin particles is larger, this is considered to enable improvement of the fixing qualities. And since the resin particles are not directly involved in image forming, it is considered that occurrences, are suppressed, of a problem of the toner color-producing qualities being reduced and sufficient image density not being able to be obtained. On the other hand, since the mean domain diameter of the wax of the toner base particles is smaller, this is considered to enable the toner color-producing qualities to be sufficiently improved. Here, the aforementioned problems due to making smaller the mean domain diameter of the wax so as to sufficiently improve the toner color-producing qualities, that is, the problem that fixing qualities are reduced, is considered to be that since the fixing qualities are improved by the resin particles, the overall fixing qualities can be sufficiently maintained, and the smoothness of the surface of the image to be formed can be sufficiently improved. Accordingly, it is considered possible to improve the fixing qualities and simultaneously improve the toner color-producing qualities by using a configuration of resin particles, which enable the fixing qualities to be improved, and toner base particles, which are directly involved in image forming, as separate particles. And since colorants are not contained in the resin particles, whose wax mean domain diameter is larger, it is considered that occurrences of fogging are suppressed.

Further still, the resin particles are not used separately to the toner containing the toner base particles, that is, the resin particles are mixed with the toner base particles, and are used in a state in which external additives are externally added to both, and therefore it is not necessary to additionally provide a developing device for using the resin particles, and it is not necessary to complicate the configuration of the image forming apparatus in which the toner is to be applied.

Thus, for these reasons it is considered the toner is superior in all of toner color-producing qualities, image surface smoothness, and fixing qualities without complicating the configuration of the image forming apparatus to which the toner is to be applied, and further still is capable of suppressing occurrences of fogging.

Furthermore, the mean domain diameter of the wax can be adjusted according to the content amount of wax and manufacturing conditions of the toner base particles and resin particles, for example, kneading conditions or the like. It should be noted that the mean domain diameter of the wax refers to a numerical mean value of a circle-equivalent diameter (diameter) of the wax dispersed in a state of a fine particle or the like in the toner base particles and the resin particles. A measurement method thereof can be achieved, for example, by viewing cross sections of the toner base particles and the resin particles using a transmission electron microscope, then using an image analyzing device to analyze the obtained image.

There is no particular limitation to the mean domain diameter of the wax in the resin particles as long as it is larger than the mean domain diameter of the wax in the toner base particles. Specifically, for example, it is sufficient for the mean domain diameter of the wax in the resin particles to exceed one-times the mean domain diameter of the wax in the toner base particles, but 1.5 to 3 times is preferable.

Also, it is sufficient for the mean domain diameter of the wax in the toner base particles to satisfy the above-mentioned relationship, but specifically, 0.1 to 2 μm is preferable. Furthermore, it is sufficient for the mean domain diameter of the wax in the resin particles to satisfy the above-mentioned relationship, but specifically, 0.3 to 5 μm is preferable.

If the mean domain diameter of the wax in the toner base particles is too small, there tends to be a reduction in fixing qualities. This is considered to be because the resin particles improve the fixing qualities as described above, and due to the fixing qualities of the actual toner base particles being reduced, and that compatibility becomes more difficult between the toner base particles and the resin particles during fixing. Furthermore, when the mean domain diameter of the wax in the toner base particles is too large, this indicates poor dispersion of the colorants, and therefore there is a probability that the toner color-producing qualities in the formed image will be reduced and the image densities will be below the desired values.

Furthermore, when the mean domain diameter of the wax in the resin particles is too small, it becomes difficult to satisfy the above-described relationship with the mean domain diameter of the wax in the toner base particles. Furthermore, when satisfying the above-described relationship, the mean domain diameter of the wax in the toner base particles and the mean domain diameter of the wax in the resin particles both become too small, which tends to reduce the fixing qualities. Furthermore, when the mean domain diameter of the wax in the resin particles is too large, there tends to be a reduction in the toner color-producing qualities and the like. This is considered to be because the amount of wax contained in the resin particles is too large, and therefore the amount of wax desorption from the resin particles becomes large. That is, it is considered that the toner base particles improve the toner color-producing qualities as described above, and therefore wax that has separated from the resin particles transitions to the toner base particles. Further still, there is a probability that the anti-blocking qualities of the toner will be reduced, and desorption of the wax from the toner base particles and the resin particles will occur.

Thus, due to the mean domain diameter of the wax in the toner base particles being 0.1 to 2 μm, and the mean domain diameter of the wax in the resin particles being 0.3 to 5 μm, superiority can be achieved for all of toner color-producing qualities, image surface smoothness, and fixing qualities, and further still, occurrences of fogging can be suppressed.

Furthermore, it is preferable that a content ratio of the wax in the resin particles is higher than a content ratio of the wax in the toner base particles. By doing this, superiority can be achieved for all of toner color-producing qualities, image surface smoothness, and fixing qualities, and further still, occurrences of fogging can be suppressed.

This is considered to be because the wax for improving the fixing qualities particularly achieves this effect in regard to the resin particles, and therefore by increasing the content ratio of the wax in the resin particles, more improved fixing qualities can be achieved while suppressing reductions in capabilities other than fixing qualities.

Furthermore, it is preferable that a content amount of the toner base particles with respect to a total of 100 parts by mass of the toner base particles and the resin particles is 75 to 95 parts by mass. When the content amount of toner base particles is too small, the toner color-producing qualities are reduced, and there is a probability that sufficient image densities cannot be obtained. Furthermore, when the content amount of toner base particles is too great, the content amount of resin particles becomes too small, and there is a probability that an effect in which the fixing qualities are improved while the superior toner color-producing qualities are obtained cannot be sufficiently maintained. Thus, by ensuring the content amount of the toner base particles is within the above-described range, superiority can be achieved for all of toner color-producing qualities, image surface smoothness, and fixing qualities, and further still, occurrences of fogging can be suppressed.

<Toner Base Particles>

There is no particular limitation to the toner base particles as long as the toner base particles contain a binder resin, a colorant, and a wax; that the mean domain diameter of the wax satisfies the above-described relationship, and that the toner base particles in a form capable of being used as toner base particles. A spherical shape is preferable for the toner base particles, and a preferable particle diameter is 3 to 9 μm in volume mean diameter. It should be noted that here volume mean diameter, for example, can be obtained by measurements based on a laser diffraction scattering method, or measurements using an ordinary particle size meter or the like.

(Binder Resin)

There is no particular limitation to the binder resin that can be used as long as the binder resin can be used as a conventional binder resin of toner base particles. Specifically, examples include polystyrene resins such as styrene-acrylic copolymers and styrene-butadiene resins; acrylic resins; polyethylene resins; polypropylene resins; vinyl chloride resins; polyester resins; polyamide resins; polyurethane resins; polyvinyl alcohol resins; vinyl ether resins; and N-vinyl resins. Among these, polyester resins are preferably used in that they have superior low temperature fixing qualities and a wide non-offset temperature range. Furthermore, each of the above-mentioned binder resins may be used independently or may be used in a combination of two or more as the binder resin.

Examples of the above-mentioned polyester resins include those obtained by condensation polymerization or co-condensation polymerization of an alcohol component and a carboxylic acid component. Furthermore, any of the following can be cited as a component to be used when synthesizing the polyester resin.

There is no particular limitation to the alcohol component as long as it is usable as an alcohol component for synthesizing a polyester resin. Furthermore, it is necessary for the alcohol component to contain alcohol (dihydric or higher polyhydric alcohol) having two or more hydroxyl groups intramolecularly. Specific examples of a dihydric alcohol among those that can be used as the alcohol component include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, cyclohexanedimethanol, dipropylene glycol, polyethylene glycol, polypropylene glycol, and polytetramethylene glycol; and bisphenols such as bisphenol A, hydrogenated bisphenol A, polyoxyethylenated bisphenol A, and polyoxypropylenated bisphenol A. Furthermore, specific examples of a trihydric or higher polyhydric alcohol among those that can be used as the alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene. Furthermore, each of the above-mentioned components may be used independently or may be used in a combination of two or more as the alcohol component.

Furthermore, there is no particular limitation to the carboxylic component as long as it is usable as a carboxylic component for synthesizing a polyester resin. Furthermore, the carboxylic component includes not only carboxylic acid, but also acid anhydrides and lower alkyl esters or the like of carboxylic acids. And it is necessary for the carboxylic component to contain carboxylic acid (dicarboxylic or higher polycarboxylic acid) having two or more carboxyl groups in a molecule. Specific examples of a dicarboxylic acid among those that can be used as the carboxylic component include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkyl succinic acid, and alkenyl succinic acid. N-butyl succinic acid, isobutyl succinic acid, n-octyl succinic acid, n-dodecyl succinic acid, and isododecyl succinic acid can be, for example, cited as alkyl succinic acids. N-butenyl succinic acid, isobutenyl succinic acid, n-octenyl succinic acid, n-dodecenyl succinic acid, and isododecenyl succinic acid can be, for example, cited as alkenyl succinic acids. Furthermore, specific examples of a tricarboxylic or higher polycarboxylic acid among those that can be used as the carboxylic acid include, 1,2,4-benzene tricarboxylic acid (trimellitic acid), 1,2,5-benzene tricarboxylic acid, 2-5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxylic-2-methyl-2-methylene carboxylic propane, 1,2,4-cyclohexane tricarboxylic acid, tetra (methylene carboxylic) methane, 1,2,7,8-octane tetra carboxylic acid, pyromellitic acid, and empol trimeric acid. Furthermore, each of the above-mentioned components may be used independently or may be used in a combination of two or more as the carboxylic acid component.

The polystyrene resin may be a homopolymer of styrene, or may be a copolymer of styrene and another copolymerizable polymerized monomer. P-chlorostyrene; vinyl naphthalene; olefin hydrocarbons (alkene) such as ethylene, propylene, butylene, and isobutylene; vinyl halides such as vinyl chloride, vinyl bromide, and vinyl fluoride; vinyl esters such as vinyl acetate, vinyl propionate, vinyl benzoate, and vinyl butyrate; acrylic acid esters such as methyl acrylate, ethyl acrylate, n-butyl acrylate, isobutyl acrylate, dodecyl acrylate, n-octyl acrylate, 2-chloro ethyl acrylate, phenyl acrylate, and α-chloro methyl acrylate; methacrylates such as methyl methacrylate, ethyl methacrylate, and butyl methacrylate; acrylate derivatives such as acrylic nitrile, methacrylonitrile, and acrylamide; vinyl ethers such as vinyl methyl ether and vinyl isobutyl ether; vinyl ketones such as vinyl methyl ketone, vinyl ethyl ketone, and methyl isopropenyl ketone; and N-vinyl compounds such as N-vinyl pyrrole, N-vinyl carbazole, N-vinyl indole, and N-vinyl pyrrolidene can be, for example, cited as polymerized monomer. Among these, from a perspective of superior low-temperature fixing qualities, charge stability, and environmental stability, ester acrylate is preferable, and even more preferable is n-butyl acrylate. Furthermore, each of the above-mentioned monomers may be used independently or may be used in a combination of two or more as the polymerized monomer. It should be noted it is preferable that the polystyrene resin has two weight-average molecular weight peaks (a low molecular weight peak and a high molecular weight peak). Specifically, it is preferable for example that the low molecular weight peak is within a range of 3,000 to 20,000, and the high molecular weight peak is within a range of 300,000 to 1,500,000. Further still, in regard to a weight-average molecular weight (Mw) and a number average molecular weight (Mn), it is preferable that Mw/Mn is 10 or higher. If the weight-average molecular weight peaks are within these ranges, the toner can be fixed easily, and toner offset resistance can be improved.

Although it is preferable to use a thermoplastic resin such as those described above for the binder resin from a perspective of fixing qualities, it is not necessary for this to be only a thermoplastic resin, and it is also possible to use a cross-linking agent or thermosetting resin combined with the thermoplastic resin. By introducing a portion of a cross-linked structure into the binder resin in this manner, qualities such as the preservation stability, the structural maintainability, and the durability of the toner can be improved while suppressing reductions in fixing qualities.

(Colorant)

Commonly known pigments or dyes can be used as the colorant so as to achieve a desired color as toner. Specifically, the following colorants can be cited for example in accordance with color. Carbon blacks such as acetylene black, lamp black and aniline black can be, for example, cited as black pigments. Chrome yellow, zinc yellow, cadmium yellow, yellow iron oxide, mineral fast yellow, nickel titanium yellow, navels yellow, naphtol yellow S, hansa yellow G, hansa yellow 10G, benzidine yellow G, benzidine yellow GR, quinoline yellow lake, permanent yellow NCG, tartrazine lake and C. I. pigment yellow 180 can be, for example, cited as yellow pigments. Reddish chrome yellow, molybdenum orange, permanent orange GTR, pyrazolone orange, vulcan orange indanthrene brilliant orange RK, benzidine orange G, and indanthrene brilliant orange GK can be, for example, cited as orange pigments. Colcothar, cadmium red, red lead, mercury sulfide cadmium, permanent red 4R, lithol red, pyrazolone red, watching red calcium salt, lake red D, brilliant carmine 6B, eosin lake, rhodamine lake, alizarin lake, brilliant carmine 3B and C. I. pigment red 238 can be, for example, cited as red pigments. Manganese violet, fast violet B and methyl violet lake can be, for example, cited as violet pigments. Prussian blue, cobalt blue, alkali blue lake, Victoria blue lake, phthalocyanine blue, metal-free phthalocyanine blue, phthalocyanine blue-partial chlorination product, fast sky blue, indanthrene blue BC and C. I. pigment blue-15:3 (copper phthalocyanine blue pigment) can be, for example, cited as blue pigments. Chrome green, chrome oxide, pigment green B, malachite green and Fanal yellow green G can be, for example, cited as green pigments. Zinc white, titanium oxide, antimony white, zinc sulfide, baryte powder, barium carbonate, clay, silica, white carbon, talc and alumina white can be, for example, cited as white pigments. For example, C.I. pigment blue 15:3 (copper phthalocyanine blue pigment) is preferable as a colorant of cyan toner.

To achieve suitable image densities, an additive amount of the colorant is generally 1 to 10 parts by mass with respect to 100 parts by mass of binder resin, and is preferably 3 to 7 parts by mass.

(Wax)

There is no particular limitation to the wax that can be used as long as it can be used as a conventional wax of toner base particles. Specific examples thereof include plant derived wax such as carnauba wax, sugarcane wax, and wood wax; animal derived wax such bee wax, insect wax, whale wax, and lanolin; and synthetic hydrocarbon wax such as Fischer-Tropsch (hereinafter sometimes referred to as "FT") wax, polyethylene wax, and polypropylene wax. Among these, from a perspective of superior dispersion qualities in the binder resin, FT wax or carnauba wax is preferable, and carnauba wax is more preferable.

There is no particular limitation to the content amount of wax in the toner base particles as long as the mean domain diameter of the wax satisfies the above-described relationship. Specifically, it is preferable that a content amount of the wax in the toner base particles is 1 to 10 parts by mass with respect to 100 parts by mass of the binder resin for example. In a case where this content amount of wax in the toner base particles is too small, the mean domain diameter of the wax in the toner base particles tends to become too small, and there is a probability that problems such as those described above will occur when the mean domain diameter of the wax in the toner base particles is too small. And, in a case where this content amount of wax in the toner base particles is too large, the mean domain diameter of the wax in the toner base particles tends to become too large, and there is a probability that problems such as those described above will occur when the mean domain diameter of the wax in the toner base particles is too large.

(Charge-Controlling Agent)

It is common for a charge-controlling agent to be included with the toner base particles to improve the charging qualities and the like. Furthermore, the toner is toner constituted by the positively charged two-component developer, that is, a positively charged toner, and therefore there is no particular limitation among conventional charge-controlling agents of toner base particles to the charge-controlling agent that is used as long as it is a charge-controlling agent that indicates a positive charge. Specific examples thereof include charge-controlling agent with a positive electrification property such as nigrosine, quaternary ammonium salt compounds and resin type charge-controlling agents in which an amine compound is combined with resin. Furthermore, an additive amount of the charge-controlling agent is preferably 0.5 to 10 parts by mass with respect to 100 parts by mass of the binder resin, or more preferably added as 1 to 5 parts by mass. In a case where the additive amount of the charge-controlling agent is too small, it becomes difficult to stably charge the toner to the desired polarity, and there is a probability that fogging will occur more easily. Furthermore, in a case where the additive amount of the charge-controlling agent is too large, there are charging problems and image problems due to environment resistance, particularly under high temperatures and high humidity, and there is a probability that disadvantages such as contamination of the photoconductor will occur more easily.

(Manufacturing Method)

Furthermore, although there is no particular limitation to the manufacturing method of the toner base particles, it can be manufactured in a following manner for example.

First, each of the above-described components of the toner base particles such as the binder resin and the colorant are mixed in a mixing machine or the like. The mixer can be a known one and is, for example, a Henschel type mixer such as a Henschel Mixer™, a super mixer or a Mechanomill, an Ongumill™, a hybridization system or a Cosmosystem™.

Next, the obtained mixture is fused and kneaded in a kneading machine or the like. The kneading machine can be a known one and is, for example, a twin-screw extruder, a triple roll mill, or a laboblast mill. The twin-screw extruder is preferably used. Furthermore, it is preferable that the temperature during fusing and kneading is not less than the softening point of the binder resin, and is a temperature that is less than the decomposition temperature of the binder resin.

Next, the obtained fused and kneaded matter is cooled to become a solid material, and the solid material is pulverized in a pulverizer or the like. The pulverizer can be a known one and is, for example, an air flow system pulverizer such as a jet system pulverizer (jet mill) that pulverizes using an ultrasonic jet air flow, a mechanical system pulverizer such as a turbo mill or the like, and an impact system pulverizer or the like. The a mechanical system pulverizer, particularly a turbo mill, is preferably used.

Finally, the obtained ground material is classified in a classifier or the like. By performing classification, excessively ground material and coarse powder can be removed, and a desired toner base particle can be obtained. The classifier can be a known one and is, for example, a wind power classifier such as a swivel system pneumatic classifier (rotary system pneumatic classifier) such as an elbow-jet, or a centrifugal force classifier or the like. The pneumatic classifier, particularly an elbow-jet, is preferably used.

<Resin Particles>

There is no particular limitation to the resin particles as long as the resin particles contain a binder resin and wax, but substantially does not contain a colorant, and that mean domain diameter of the wax satisfies the above-described relationship. And other than that the resin particles substantially do not contain a colorant, those structures are equivalent to the toner base particles. Specifically, for example, spherical shapes are preferable for the resin particles, and a preferable particle diameter is approximately equivalent to the toner base particles, specifically, 3 to 9 μm in volume mean diameter.

(Binder Resin)

There is no particular limitation to the binder resin that can be used as long as the binder resin can be used as a conventional binder resin of toner base particles. Specifically, for example, a binder resin equivalent to that in the toner base particles can be cited. And its content amount is also equivalent to the toner base particles.

(Wax)

There is no particular limitation to the wax that can be used as long as the wax can be used as a conventional wax of toner base particles. Specifically, for example, a wax equivalent to that in the toner base particles can be cited as a conventional wax of toner base particles.

There is no particular limitation to the content amount of the wax in the resin particles as long as the mean domain diameter of the wax satisfies the above-described relationship. Specifically, it is preferable that a content amount of the wax in the resin particles is 5 to 15 parts by mass with respect to 100 parts by mass of the binder resin for example. In a case where the content amount is too small, the mean domain diameter of the wax in the resin particles tends to become too small, and there is a probability that problems such as those described above will occur when the mean domain diameter of the wax in the resin particles is too small. Furthermore, in a case where the content amount is too large, the mean domain diameter of the wax in the resin particles tends to become too large, and there is a probability that problems such as those described above will occur when the mean domain diameter of the wax in the resin particles is too large.

(Charge-Controlling Agent)

There is no particular limitation to the charge-controlling agent that can be used as long as the charge-controlling agent can be used as a conventional charge-controlling agent of toner base particles. Specifically, for example, a charge-controlling agent equivalent to that in the toner base particles can be cited as a conventional charge-controlling agent of toner base particles. And its content amount is also equivalent to the toner base particles.

(Manufacturing Method)

Furthermore, there is no particular limitation to the manufacturing method of the resin particles. Specifically, for example, the resin particles can be manufactured in a same manner as the toner base particles.

<External Additives>

The toner for electrophotography is obtained by externally adding an external additive to the toner base particles and the resin particles. That is, the toner for electrophotography is obtained by executing an external addition process on the toner base particles and the resin particles.

There is no particular limitation to the external addition process as long as the external addition process is a conventional commonly known external addition process. Specifically, for example, the external addition process is a process in which, by adding an external additive to the toner base particles and the resin particles, then agitating these with an agitator or the like, the external additive is caused to adhere or fasten to a surface of the toner base particles and the resin particles.

There is no particular limitation to the external additive that can be used as long as the external additive can be used as a conventional external additive of toner. Silica particles, titanium oxide particles, alumina particles, and magnetite particles can be, for example, cited as the external additive. Among these, silica particles and titanium oxide particles are preferable from a perspective of superior fluidity, charging qualities, and abrasive qualities, and combined use of silica particles and titanium oxide particles is more preferable. By doing this, superiority can be achieved for all of toner color-producing qualities, image surface smoothness, and fixing qualities, and further still, occurrences of fogging can be suppressed. This is considered to be because the silica particles improve the fluidity of the toner, and the titanium oxide particles improve the abrasive qualities of the toner with respect to the photosensitive drum. Furthermore, each of the above-mentioned external additives may be used independently or may be used in a combination of two or more as the external additive.

Furthermore, it is preferable that a content amount of the external additive with respect to 100 parts by mass of the toner base particles and the resin particles is 0.2 to 3 parts by mass.

A conventional commonly known agitator can be used without limitation as the agitator. The agitator can be a known one and is, for example, a turbine type agitator, a Henschel mixer, or a super mixer or the like.

[Developer]

The developer containing the toner for electrophotography may be a one-component developer that contains the toner for electrophotography but does not contain carrier, or may be two-component developer that contains the toner for electrophotography and carrier, but two-component developer can be used favorably. Here, description is given regarding two-component developer. It should be noted that developer according to another embodiment of the present disclosure is developer that contains the toner for electrophotography and carrier. By doing this, developer can be obtained that is superior in all of toner color-producing qualities, image surface smoothness, and fixing qualities without complicating the configuration of the image forming apparatus to which the developer is to be applied, and further still is capable of suppressing occurrences of fogging.

(Carrier)

There is no particular limitation to the carrier as long as the carrier can be used as carrier of developer. A ferrite carrier or one in which a surface of a magnetic particle, which is the carrier core, is covered by a resin can be, for example, cited as the carrier. Magnetic metals such as iron, nickel, and cobalt, alloys of these, alloys containing a rare earth, soft ferrites such as hematite, magnetite, manganese-zinc ferrites, nickel-zinc ferrites, manganese-magnesium ferrites, lithium ferrites, iron oxides such as copper-zinc ferrites, and magnetic particles manufactured by carrying out sintering or atomizing or the like on magnetic materials such as mixtures of these can be, for example, cited as the carrier cores.

Binder resins such as silicone resin and acrylic resin and fluororesins such as polytetrafluoroethylene, polychlorotrifluoroethylene and polyvinylidene fluoride can be, for example, cited as a surface coating agent for coating the surfaces of the carrier core materials obtained as described above are. Among these, a silicone resin is preferable from a perspective of superior charging stability and durability. Furthermore, each of the above-mentioned surface coating agents may be used independently or may be used in a combination of two or more as the surface coating agent. Mixtures of binder resins such as silicone resin and acrylic resin and fluororesins such as polytetrafluoroethylene, polychlorotrifluoroethylene and polyvinylidene fluoride can be, for example, cited as a combination of two or more as the surface coating agent.

A particle diameter of the carrier is preferably within a range of 20 to 200 μm at a volume average diameter, and more preferably within a range of 30 to 150 μm. It should be noted that here volume average diameter, for example, can be obtained by measurements based on a electron microscopy, measurements based on a laser diffraction scattering method, and measurements using an ordinary particle size meter or the like. The apparent density of the carrier varies according to the composition or surface structure of the magnetic substance when a magnetic material is a main component, by generally it is preferable to be within a range of 3 to 8 g/cm$^3$.

The toner density of the two-component developer containing the toner for electrophotography and the carrier is preferably 1 to 20 mass %, and more preferably 3 to 15 mass %. When the toner density is too low, there is a probability that the image density will come too light. And when the toner density is too high, there is a probability that toner scattering will occur inside the developing device, thereby causing problems such as smearing inside the device, or adherence of toner in undesired locations such as on the transfer papers. Accordingly, by keeping the toner densities within the above-described range, high image densities can be achieved, and moreover it possible to suppress scattering of toner occurring inside the developing device, thereby causing problems such as smearing inside the device, or adherence of toner in undesired locations such as on the transfer papers.

Developer according to the present embodiment is two-component developer in which the toner for electrophotography and the carrier are mixed at an appropriate ratio, and can be used in an image forming apparatus described below for example.

[Image Forming Apparatus]

There is no particular limitation to the image forming apparatus using the toner for electrophotography and the developer as long as the image forming apparatus is an electrophotographic method image forming apparatus. Furthermore, a tandem system color image forming apparatus using toners of multiple colors such as that described below is preferable. A tandem system color image forming apparatus that uses toners of multiple colors such as that described below can be, for example, cited as a tandem system color image forming apparatus. Here, description is given regarding a tandem system color image forming apparatus. It should be noted that an image forming apparatus that uses developer according to the present embodiment is provided with multiple image bearing members, which are arranged in rows in a predetermined direction to form toner images using different color toners on each of their surfaces, and development rollers, each of which is disposed in opposition to the respective image bearing member to hold and transport the toner on their surface, then supply the transported toner to the respective surface of each of the image bearing members, and uses the above-described developer as the developer.

FIG. 1 is an outline cross-sectional view showing an overall configuration of a color printer 1 in which toner for electrophotography according to a present embodiment of the present disclosure is applied. Here, a color printer 1 is described as an example of the image forming apparatus 1.

The color printer 1 has a box shaped device main body 1*a* as shown in FIG. 1. Provided in this device main body 1*a* are a paper supply portion 2 that supplies paper P, an image forming portion 3 that transfers a toner image based on image data or the like onto the paper P while the paper P is transported from the paper supply portion 2, and a fixing portion 4 that executes a fixing process in which an unfixed toner image that has been transferred onto the paper P by the image forming portion 3 is fixed onto the paper P. Further still, at an upper surface of the device main body 1*a*, a paper discharge portion 5 is provided that receives the discharged paper P on which the fixing process has been executed by the fixing portion 4.

The paper supply portion 2 is provided with paper supply cassette 21, a pickup roller 22, paper feeding rollers 23, 24, and 25, and registration rollers 26. The paper supply cassette 21 are provided so as to be removable from the device main body 1*a*, and store papers P of various sizes. The pickup roller 22 is arranged in a top left position of the paper supply cassette 21 shown in FIG. 1, and the papers P stored in the paper supply cassette 21 are drawn out sheet by sheet. The paper feeding rollers 23, 24, and 25 feed out the papers P that have been drawn out by the pickup roller 22 onto a paper transport path. The registration rollers 26 feed the paper P to the image forming portion 3 with a predetermined timing after causing the paper P that has been fed out onto the paper transport path by the paper feeding rollers 23, 24, and 25 to standby.

Furthermore, the paper supply portion 2 is further provided with an unshown manual feed tray and a pickup roller 27, which is provided on a left lateral surface of the device main body 1*a* shown in FIG. 1. The pickup roller 27 draws out the paper P that is loaded on the manual feed tray. The paper P that has been drawn out by the pickup roller 27 is fed out to the paper transport path by the paper feeding rollers 23, and 25, then fed to the image forming portion 3 with a predetermined timing by the registration rollers 26.

The image forming portion 3 is provided with image forming units 7, an intermediate transfer belt 31 on which toner images have undergone primary transfer by the image forming units 7 to the surfaces (contact surfaces) thereof based on image data electronically transferred from a computer or the like, and a secondary transfer roller 32 for performing secondary transfer of the toner image on the intermediate transfer belt 31 to the paper P fed from the paper supply cassette 21.

The image forming units 7 are provided with a black unit 7K, a yellow unit 7Y, a cyan unit 7C, and a magenta unit 7M, which are arranged in order from an upstream side (right side in FIG. 1) to a downstream side. A photosensitive drum 37 is arranged so as to be rotatable in an arrow (clockwise) direction as an image bearing member in a central position of each of the units 7K, 7Y, 7C, and 7M respectively. And arranged in order from the upstream side in the rotation direction of the photosensitive drums 37 around each of the photosensitive drums 37 are a charger 39, an exposure device 38, a developing device 71, and an unshown cleaning device and neutralization unit.

The charger 39 uniformly charges a circumferential surface of the photosensitive drum 37, which rotates in the arrow direction. A corotron type charger and a scorotron charger having a noncontact type charging system, and a charging roller and charging brush or the like having a contact system can be, for example, cited as the charger 39. The exposure device 38 is a so called laser scanning unit, that irradiates a laser beam on the circumferential surface of the photosensitive drum 37, which has been uniformly charged by the charger 39, based on image data inputted from a higher order device such as a personal computer (PC), thereby forming an electrostatic latent image on the photosensitive drum 37 based on the image data. The developing device 71 forms a toner image based on the image data by supplying toner to the circumferential surface of the photosensitive drum 37 on which the electrostatic latent image has been formed. Then, the toner image undergoes primary transfer to the intermediate transfer belt 31. The cleaning device cleans toner that is residual on the circumferential surface of the photosensitive drum 37 after primary transfer of the toner image onto the intermediate transfer belt 31 has been completed. The neutralization unit removes electricity from the circumferential surface of the photosensitive drum 37 after primary transfer has been completed. The circumferential surface of the photosensitive drum 37, which has undergone cleaning processes by the cleaning device and the neutralization unit, then moves toward a position in opposition to the charger for a new charging, and a new charging is carried out.

The intermediate transfer belt 31 is an endless belt shaped rotating body, and winds around multiple rollers such as a drive roller 33, an idler roller 34, a backup roller 35, and primary transfer rollers 36 so that its surface (contact surface) side contacts the circumferential surfaces of each of the photosensitive drums 37 respectively. Furthermore, the intermediate transfer belt 31 is configured so as to rotate endlessly by way of the multiple rollers in a state in which the intermediate transfer belt 31 is pressed against the photosensitive drums 37 by the primary transfer rollers 36, which are arranged in opposition to each of the photosensitive drums 37. The drive roller 33 is rotationally driven by a drive source such as a stepping motor, and transmits a drive force for causing the intermediate transfer belt 31 to rotate endlessly. The idler roller 34, the backup roller 35, and the primary transfer rollers 36 are arranged so as to rotate freely, and rotate idly along with endless rotation of the intermediate transfer belt 31 caused by the drive roller 33. These rollers 34, 35, and 36 rotate idly by way of the intermediate transfer belt 31 in response to the main drive rotation of the drive roller 33, and support the intermediate transfer belt 31.

The primary transfer rollers 36 apply a first transfer bias (a reverse polarity to the charged polarity of the toner) to the intermediate transfer belt 31. By doing this, each of the toner images formed on the photosensitive drums 37 is transferred in order (primary transfer) in a superimposed state onto the intermediate transfer belt 31, which circles in the arrow (counterclockwise) direction due to the drive of the drive roller 33, between each of photosensitive drums 37 and each of the primary transfer rollers 36.

The secondary transfer roller 32 applies a secondary transfer bias of a reverse polarity of the toner image to the paper P. By doing this, the toner images that have undergone primary transfer onto the intermediate transfer belt 31 are transferred to the paper P between the secondary transfer roller and the backup roller 35, and in this way a color transfer image (unfixed toner image) is transferred onto the paper P.

The fixing portion 4 executes a fixing process on the transfer image that is transferred onto the paper P by the image forming portion 3, and is provided with a heat roller 41, which applies heat using an electric heating member, and a pressure roller 42, which is arranged in opposition to the heat roller 41, and whose circumferential surface presses and contacts the circumferential surface of the heat roller 41.

Then, the transfer image that has been transferred onto the paper P by the secondary transfer roller 32 in the image forming portion 3 is fixed onto the paper P with the fixing process due to heat applied when the paper P passes between the heat roller 41 and the pressure roller 42. Then the paper P on which the fixing process has been executed is discharged to a discharge portion 5. Furthermore, transport rollers 6 are arranged in appropriate locations between the fixing portion 4 and the discharge portion 5 in the color printer 1 according to the present embodiment.

The discharge portion 5 is formed by a top portion of the device main body 1*a* of the color printer 1 being provided in a concave manner, thereby forming the paper discharge tray 51, which receives the papers P that have been discharged into a bottom portion of this concave indentation.

Figure 2:
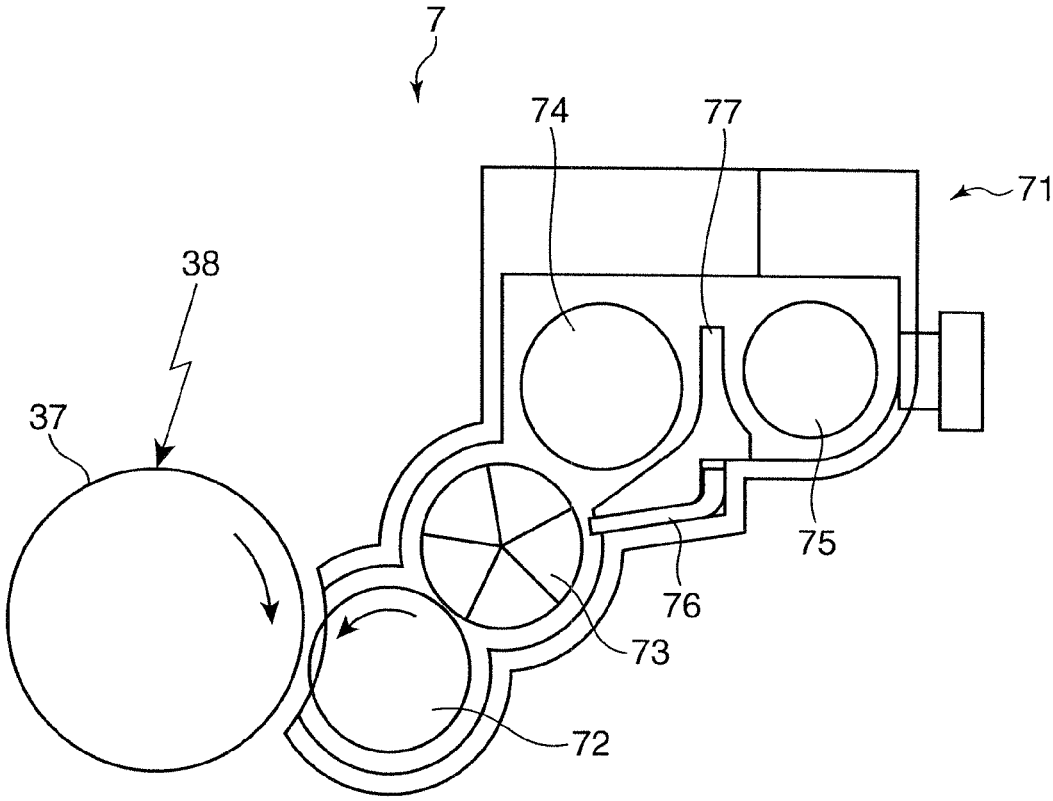
FIG. 2 is an outline cross-sectional view showing a configuration of a developing device 71 provided in the color printer 1.

Next, description is given regarding a configuration of the developing device 71 provided in the color printer 1. FIG. 2 is an outline cross-sectional view showing a configuration of a developing device 71 provided in the color printer 1 shown in FIG. 1, and is an enlarged view of areas peripheral to the developing device 71 provided in the color printer 1.

The developing device 71 is provided with a development roller 72, a magnetic roller 73, a paddle mixer 74, an agitating mixer 75, a tipped blade 76, and a partitioning panel 77.

The development roller 72 manifests (develops) the electrostatic latent image already formed on the surface of the photosensitive drum 37 into a toner image by holding and transporting toner on the surface thereof. Furthermore, the development roller 72 is internally mounted with a magnet so as to form a magnetic pole in a position that is in opposition to the magnetic roller 73. The magnetic roller 73 adsorbs the two-component developer using a magnet that is securely arranged internally, thereby forming a magnetic brush to supply toner to the development roller 72. Since a magnet is internally mounted in the development roller 72, the magnetic brush constituted by the two-component developer, which is formed between the development roller 72 and the magnetic roller 73, is formed more strongly, and toner that has not been used in the development on the development roller 72 can be better stripped, and therefore a tracking phenomenon or fogging in the formed image can be suppressed, and a higher development performance can be achieved.

The paddle mixer 74 and the agitating mixer 75 have spiral shaped blades that transport and agitate the two-component developer in reverse directions to each other, thereby charging the toner. Further still, the paddle mixer 74 supplies the two-component developer containing the charged toner and the carrier to the magnetic roller 73. The tipped blade 76 regulates the thickness of the magnetic brush formed on the magnetic roller 73 to a predetermined value. The partitioning panel 77 is provided between the paddle mixer 74 and the agitating mixer 75, and the two-component developer can freely pass on the outer sides from the end sides of the partitioning panel 77.

Figure 3:
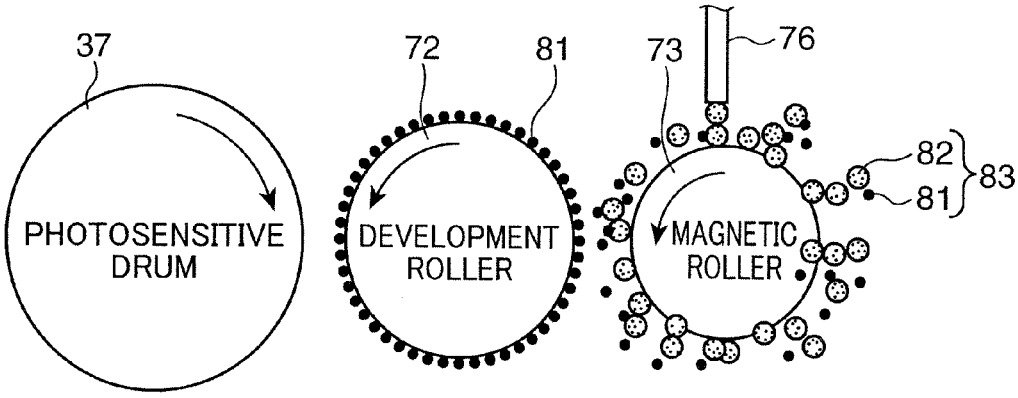
FIG. 3 is an outline diagram for describing development using the developing device 71.

FIG. 3 is an outline diagram for describing development of the developing device 71. FIG. 3 is an outline diagram for describing development of the developing device 71, wherein the positional relationships among the photosensitive drum 37, the development roller 72, the magnetic roller 73, and the tipped blade 76 are different from FIG. 2.

Two-component developer 83 containing toner 81 charged by the agitating of the paddle mixer 74 and the agitating mixer 75 and carrier 82 is supplied to the magnetic roller 73. The two-component developer 83 supplied to the magnetic roller 73 is transported becoming a magnetic brush due to the magnet within the magnetic roller 73. After this, the magnetic brush moves with the rotation of a sleeve of the surface of the magnetic roller 73, and thickness of the magnetic brush is regulated when the magnetic brush passes between the tipped blade 76 and the magnetic roller 73. Then, when the magnetic brush, whose thickness is regulated, moves to the vicinity of the development roller 72, only the charged toner 81 moves to the development roller 72 by the electric potential difference produced between the development roller 72 and the magnetic roller 73. The toner 81 that has moved to the development roller 72 becomes a uniform toner layer. Then, development is carried out based on the electrostatic latent image that is formed on the photosensitive drum 37 by the electric potential difference produced between the electrostatic latent image formed on the photosensitive drum 37 and the development roller 72.

Thus, the developing device 71 can develop the electrostatic latent image formed on the photosensitive drum 37 by mean of the above-described operations.

The image forming apparatus 1 carries out image formation on the paper P according to the above-described development operations and image formation operations. And since the above-described tandem system image forming apparatus uses the toner for electrophotography, superiority can be achieved for all of toner color-producing qualities, image surface smoothness, and fixing qualities, and further still, occurrences of fogging can be suppressed. Accordingly, images having high image quality can be formed over a long period.

EXAMPLES

Hereinafter, the present disclosure is described more specifically using examples. It should be noted that the present disclosure is not limited to any of these examples.

First, description is given regarding a manufacturing method of the toner base particles.

(Toner Base Particles A-1)

First, 100 parts by mass of a polyester resin (number average molecular weight Mn: 6,000, glass transition temperature Tg: 60.5° C., softening point: 79.2° C.) as a binder resin, 3 parts by mass of a phthalocyanine pigment (Heliogen blue D 7079 manufactured by BASF) as a colorant, 3 parts by mass carnauba wax (manufactured by Toa Chemical Co., Ltd) as a wax, and 5 parts by mass charge-controlling resin (FCA-1001-NG manufactured by Fujikura Kasei Co., Ltd) as a charge-controlling agent were mixed in a Henschel Mixer™ (manufactured by Nippon Coke and Engineering Co., Ltd). After this, the obtained mixture was fused and kneaded by a twin-screw extruder (PCM-30 model manufactured by Ikegai Co., Ltd) under conditions of a barrel temperature of 100° C. and 250 RPM, then the obtained kneaded material was cooled so as to become a chip shape using a drum flaker (belt drum flaker manufactured by Nippon Coke and Engineering Co., Ltd). Then, the kneaded material that had been cooled into chip shapes was roughly pulverized in a feather mill (350×600 model manufactured by Hosokawa Micron Co., Ltd), then more finely pulverized in an air flow system pulverizer (jet mill IDS-2 model manufactured by Nippon Pneumatic Mfg. Co., Ltd), and underwent a classification process in an elbow jet classifier (EJ-LABO manufactured by Nittetsu Mining Co., Ltd.). By doing this, toner base particles were obtained having volume mean diameter of 8 μm. It should be noted that the volume mean diameter of the toner base particles was measured using a particle size meter (Multisizer 3 manufactured by Beckman Coulter Co., Ltd).

Then, the mean domain diameter of the wax in the obtained toner base particles (toner base particles A-1) was measured using a following method. Specifically, after the obtained toner base particles were embedded in an epoxy resin, they were produced into ultra thin cut pieces having an approximate thickness of 1,000 nm using an ultra microtome (EM UC6 manufactured by Leica Co., Ltd), and the cross sections of at least 100 toner base particles were viewed under conditions of at 30,000-fold magnification at accelerating voltage of 75 kV using a transmission electron microscope (TEM) (JEM-1011 manufactured by JEOL Ltd.). The obtain TEM images were analyzed using image analysis software (WIN ROOF from Mitani Corporation), thereby measuring a domain filet direction diameter (bounding rectangle length) of the wax. An arithmetic mean diameter of the measured filet direction diameter was set as the mean domain diameter of the wax.

The mean domain diameter of the wax in the obtained toner base particles measured in this manner (toner base particles A-1) was 0.63 μm.

(Toner Base Particles A-2)

Apart from varying the RPM of the twin-screw extruder from 250 RPM to 150 RPM, the toner base particles A-2 was manufactured in a same manner as the toner base particles A-1.

Furthermore, the mean domain diameter of the wax in the obtained toner base particles (toner base particles A-2) was 1.58 μm.

(Toner Base Particles A-3)

Apart from using 6 parts by mass of the carnauba wax instead of 3 parts by mass, the toner base particles A-3 was manufactured in a same manner as the toner base particles A-1.

Furthermore, the mean domain diameter of the wax in the obtained toner base particles (toner base particles A-3) was 1.71 μm.

(Toner Base Particles A-4)

Apart from varying the RPM of the twin-screw extruder from 250 RPM to 150 RPM, the toner base particles A-4 was manufactured in a same manner as the toner base particles A-3.

Furthermore, the mean domain diameter of the wax in the obtained toner base particles (toner base particles A-4) was 3.42 μm.

(Toner Base Particles A-5)

Apart from using 10 parts by mass of the carnauba wax instead of 3 parts by mass, the toner base particles A-5 was manufactured in a same manner as the toner base particles A-1.

Furthermore, the mean domain diameter of the wax in the obtained toner base particles (toner base particles A-5) was 2.61 μm.

(Toner Base Particles A-6)

Apart from varying the RPM of the twin-screw extruder from 250 RPM to 150 RPM, the toner base particles A-6 was manufactured in a same manner as the toner base particles A-5.

Furthermore, the mean domain diameter of the wax in the obtained toner base particles (toner base particles A-6) was 3.63 μm.

In regard to the foregoing toner base particles A-1 to A-6, the above-described items are shown summarized in table 1.

TABLE 1

| | CONTENT AMOUNT OF WAX IN 100 PARTS BY MASS OF BINDER RESIN (PARTS BY MASS) | ROTATION NUMBER (rpm) | MEAN DOMAIN DIAMETER OF WAX (μm) |
|---|---|---|---|
| A-1 | 3 | 250 | 0.63 |
| A-2 | 3 | 150 | 1.58 |
| A-3 | 6 | 250 | 1.71 |
| A-4 | 6 | 150 | 3.42 |
| A-5 | 10 | 250 | 2.61 |
| A-6 | 10 | 150 | 3.63 |

Next, description is given regarding a manufacturing method of the resin particles.

(Resin Particles B-1)

First, 100 parts by mass of a polyester resin (Almatex P645 manufactured by Mitsui Chemicals Inc.) as a binder resin, 10 parts by mass of carnauba wax (manufactured by Toa Chemical Co., Ltd) as a wax, and 5 parts by mass charge-controlling resin (FCA-1001-NG manufactured by Fujikura Kasei Co., Ltd) as a charge-controlling agent were mixed in a Henschel Mixer™ (manufactured by Nippon Coke and Engineering Co., Ltd). After this, the obtained mixture was fused and kneaded by a twin-screw extruder (PCM-30 model manufactured by Ikegai Co., Ltd) under conditions of a barrel temperature of 100° C. and 150 RPM, then the obtained kneaded material was cooled so as to become a chip shape using a drum flaker (belt drum flaker manufactured by Nippon Coke and Engineering Co., Ltd). Then, the kneaded material that had been cooled into chip shapes was roughly pulverized in a feather mill (350×600 model manufactured by Hosokawa Micron Co., Ltd), then more finely pulverized in an air flow system pulverizer (jet mill IDS-2 model manufactured by Nippon Pneumatic Mfg. Co., Ltd), and underwent a classification process in an elbow jet classifier (EJ-LABO manufactured by Nittetsu Mining Co., Ltd.). By doing this, resin particles were obtained having volume mean diameter of 8 μm. It should be noted that the volume mean diameter of the resin particles was measured using a particle size meter (Multisizer 3 manufactured by Beckman Coulter Co., Ltd).

Then, the mean domain diameter of the wax in the obtained resin particles (resin particles B-1) was measured using an equivalent method as the measurement method of mean domain diameter of wax in the toner base particles. Specifically, after the obtained resin particles were embedded in an epoxy resin, they were produced into ultra thin cut pieces having an approximate thickness of 1,000 nm using an ultra microtome (EM UC6 manufactured by Leica Co., Ltd), and the cross sections of at least 100 resin particles were viewed under conditions of at 30,000-fold magnification at accelerating voltage of 75 kV using a transmission electron microscope (TEM) (JEM-1011 manufactured by JEOL Ltd.). The obtain TEM images were analyzed using image analysis software (WIN ROOF from Mitani Corporation), thereby measuring a domain filet direction diameter (bounding rectangle length) of the wax. An arithmetic mean diameter of the measured filet direction diameter was set as the mean domain diameter of the wax.

The mean domain diameter of the wax in the obtained resin particles measured in this manner (resin particles B-1) was 3.40 μm.

(Resin Particles B-2)

Apart from using 6 parts by mass of the carnauba wax instead of 10 parts by mass, the resin particles B-2 was manufactured in a same manner as the resin particles B-1.

Furthermore, the mean domain diameter of the wax in the obtained resin particles (resin particles B-2) was 3.34 μm.

(Resin Particles B-3)

Apart from varying the RPM from 150 RPM to 250 RPM, the resin particles B-3 was manufactured in a same manner as the resin particles B-2.

Furthermore, the mean domain diameter of the wax in the obtained resin particles (resin particles B-3) was 2.05 μm.

In regard to the foregoing resin particles B-1 to B-3, the above-described items are shown summarized in table 2.

TABLE 2

| | CONTENT AMOUNT OF WAX IN 100 PARTS BY MASS OF BINDER RESIN (PARTS BY MASS) | ROTATION NUMBER (rpm) | MEAN DOMAIN DIAMETER OF WAX (μm) |
|---|---|---|---|
| B-1 | 10 | 150 | 3.40 |
| B-2 | 6 | 150 | 3.34 |
| B-3 | 6 | 250 | 2.05 |

Finally, description is given regarding a manufacturing method of the toner for electrophotography and developer.

Example 1

With 90 parts by mass of the obtained toner base particles A-1 and 10 parts by mass of the obtained resin particles B-1, 1 part by mass of silica particles (HVK-2150 manufactured by Wacker Chemie AG) and 1 part by mass of titanium oxide particles (STT-65C manufactured by Titan Kogyo Ltd.) were externally added as external additives, then mixed in a 10 L Henschel Mixer™ (manufactured by Nippon Coke and Engineering Co., Ltd). By doing this, toner for electrophotography (static charge toner) C-1 was obtained. The obtained toner C-1 was blended into a ferrite carrier having a volume mean particle diameter of 60 μm (a sample product of Powder Tech Co., Ltd) so as to achieve a toner density of 8 mass %. Then, this was agitated to uniformity using a universal bowl mill manufactured by Yamato Scientific Co., Ltd. By doing this, two-component developer (developer according to example 1) containing the toner C-1 was obtained.

Examples 2 to 9, and Comparative Examples 1 to 7

Apart from varying the toner base particles and resin particles that were used as shown in table 3, the examples 2 to 9 and comparative examples 1 to 7 are equivalent to the example 1.

Comparative Examples 8 to 13

Instead of having 90 parts by mass toner base particles and 10 parts by mass resin particles, the comparative examples 8 to 13 used 100 parts by mass of toner base particles as shown in table 3 without using resin particles, but are otherwise equivalent to the example 1.

[Evaluation]

In regard to the obtained toner and developer, evaluations were carried out using methods such as the following.

(Image Density)

First, a Kyocera Mita Corporation color MFP (KM-3232) was modified to have a processing speed of 250 mm/sec at linear velocity and a fixing temperature of 130° C., and this modified machine was used as an evaluation machine, then each of the obtained developers was used as a starting developer, and moreover each of the obtained toners was used as toner for replenishment, and image forming was performed under a normal temperature and normal humidity environment of a temperature of 20 to 23° C. and relative humidity of 50 to 65% RH, thereby carrying out the following evaluations.

Specifically, first, the starting developer was set in the evaluation machine and the power of the evaluation machine was turned on to achieve stabilization. After this, an image was outputted in which 2×2 cm solid areas were formed in three locations, namely a position near a left side edge area, a central area, and a position near a right side edge area in a transport direction of a paper. It should be noted that this image was used as an initial image. Then, areas other than the solid areas were left blank. After this, the same image was outputted on 1,000 sheets. Reflected densities were measured using a reflection density meter (RD-19A Spectro Eye LT manufactured by Gretag Macbeth) in regard to the solid areas of the image (evaluation image) outputted on the one-thousandth sheet from the initial image. Then, a mean value thereof was set as an image density ID of the obtained image.

If the measured image density ID was 1.2 or higher, it was evaluated as "A," and if it was less than 1.2 it was evaluated as "B."

(Gloss)

The gloss (degree of gloss) of the solid areas of the evaluation image was measured using a gloss meter (PG-1M manufactured by Nippon Denshoku Industries Co., Ltd.).

If the measured gloss was 8 or higher, it was evaluated as "A," and if it was less than 8 it was evaluated as "B."

(Fogging)

With the obtained evaluation image, a value in which the image density value of the base paper (that is, the blank paper prior to image output) was subtracted from the image density value of a corresponding blank page area measured by the reflection density meter was set as a fogging density FD.

If the measured fogging density FD was 0.010 or lower, it was evaluated as "A," and if it exceeded 0.010, it was evaluated as "B."

(Fixing Ratio)

First, a brass weight (1 kg) wrapped in cloth was placed on the obtained evaluation image. After this, with its own weight left exerted on the evaluation image, the weight was scrapped back and forth 10 times on the evaluation image. The image densities of the solid areas before and after this operation were measured using the reflection density meter (RD-19A Spectro Eye LT manufactured by Gretag Macbeth). Then, the fixing ratio was calculated using the following expression.

$$\text{Fixing ratio (\%)} = \text{image density before the operation} / \text{image density after the operation} \times 100.$$

Then, if the fixing ratio was 95% or higher, it was evaluated as "A," and if it was less than 95%, it was evaluated as "B."

(Overall Evaluation)

An evaluation of "A" was given to an example if it had no "B" evaluations in any of the above-described evaluation results, and an evaluation of "B" was given to an example if it had been evaluated as "B" in even one item.

The evaluation results are shown in table 3.

TABLE 3

| | TONER | | EVALUATION | | | | | | | | |
|---|---|---|---|---|---|---|---|---|---|---|---|
| | BASE PARTICLES | RESIN PARTICLES | IMAGE DENSITY ID | | GLOSS | | FOGGING DENSITY FD | | FIXING RATIO | | OVERALL EVALUATION |
| EXAMPLE 1 | A-1 | B-1 | 1.48 | A | 11 | A | 0.000 | A | 98.8 | A | A |
| EXAMPLE 2 | A-1 | B-2 | 1.47 | A | 10 | A | 0.001 | A | 97.9 | A | A |
| EXAMPLE 3 | A-1 | B-3 | 1.48 | A | 9 | A | 0.000 | A | 95.2 | A | A |
| EXAMPLE 4 | A-2 | B-1 | 1.39 | A | 12 | A | 0.001 | A | 99.3 | A | A |
| EXAMPLE 5 | A-2 | B-2 | 1.36 | A | 11 | A | 0.002 | A | 98.9 | A | A |
| EXAMPLE 6 | A-2 | B-3 | 1.34 | A | 9 | A | 0.001 | A | 95.1 | A | A |
| EXAMPLE 7 | A-3 | B-1 | 1.41 | A | 12 | A | 0.004 | A | 99.4 | A | A |
| EXAMPLE 8 | A-3 | B-2 | 1.44 | A | 11 | A | 0.002 | A | 99.4 | A | A |
| EXAMPLE 9 | A-3 | B-3 | 1.43 | A | 10 | A | 0.004 | A | 95.7 | A | A |
| COMPARATIVE EXAMPLE 1 | A-4 | B-1 | 1.19 | B | 14 | A | 0.015 | B | 99.8 | A | B |
| COMPARATIVE EXAMPLE 2 | A-4 | B-2 | 1.17 | B | 13 | A | 0.013 | B | 99.8 | A | B |
| COMPARATIVE EXAMPLE 3 | A-4 | B-3 | 1.16 | B | 12 | A | 0.014 | B | 95.6 | A | B |
| COMPARATIVE EXAMPLE 4 | A-5 | B-3 | 1.14 | B | 12 | A | 0.012 | B | 95.6 | A | B |
| COMPARATIVE EXAMPLE 5 | A-6 | B-1 | 1.09 | B | 14 | A | 0.016 | B | 99.9 | A | B |
| COMPARATIVE EXAMPLE 6 | A-6 | B-2 | 1.05 | B | 13 | A | 0.014 | B | 99.9 | A | B |
| COMPARATIVE EXAMPLE 7 | A-6 | B-3 | 1.03 | B | 12 | A | 0.015 | B | 96.9 | A | B |
| COMPARATIVE EXAMPLE 8 | A-1 | — | 1.50 | A | 4 | B | 0.000 | A | 90.0 | B | B |
| COMPARATIVE EXAMPLE 9 | A-2 | — | 1.38 | A | 5 | B | 0.002 | A | 92.1 | B | B |
| COMPARATIVE EXAMPLE 10 | A-3 | — | 1.40 | A | 6 | B | 0.003 | A | 92.9 | B | B |
| COMPARATIVE EXAMPLE 11 | A-4 | — | 1.19 | B | 9 | A | 0.014 | B | 96.6 | A | B |
| COMPARATIVE EXAMPLE 12 | A-5 | — | 1.16 | B | 8 | A | 0.011 | B | 95.1 | A | B |
| COMPARATIVE EXAMPLE 13 | A-6 | — | 1.02 | B | 10 | A | 0.015 | B | 96.2 | A | B |

As is evident from table 3, in a case of using toner for electrophotography (examples 1 to 9) that contains toner base particles containing a binder resin, a colorant, and wax; resin particles containing a binder resin and wax, but substantially not containing a colorant; and an external additive that is externally added to the toner base particles and the resin particles; and a mean domain diameter of the wax in the resin particles is larger than a mean domain diameter of the wax in the toner base particles, compared to a case of using toner for electrophotography that does not satisfy any of the conditions (comparative examples 1 to 13), the image density, gloss, and fixing ratio was higher in the formed image, and fogging was lower. Thus, it is evident that the examples 1 to 9 are toners for electrophotography that are superior in all of toner color-producing qualities, image surface smoothness, and fixing qualities, and further still are capable of suppressing occurrences of fogging. Further still, since a conventional image forming apparatus can be used as it is, the configuration of the image forming apparatus to which they are applied is not made more complicated.

This application is based on Japanese Patent application serial No. 2009-240144 filed in Japan Patent Office on Oct. 19, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. Toner for electrophotography, comprising:

toner base particles containing a binder resin, a colorant, and a wax;

resin particles containing a binder resin and a wax, but substantially not containing a colorant; and an external additive that is externally added to the toner base particles and the resin particles, wherein a mean domain diameter of the wax in the resin particles is larger than a mean domain diameter of the wax in the toner base particles.

2. Toner for electrophotography according to claim 1, wherein a content ratio of the wax in the resin particles is higher than a content ratio of the wax in the toner base particles.

3. Toner for electrophotography according to claim 1, wherein the external additive contains silica particles and titanium oxide particles.

4. Toner for electrophotography according to claim 1, wherein a content amount of the toner base particles with respect to a total of 100 parts by mass of the toner base particles and the resin particles is 75 to 95 parts by mass.

5. Toner for electrophotography according to claim 1, wherein a mean domain diameter of the wax in the toner base particles is 0.1 to 2 μm, and a mean domain diameter of the wax in the resin particles is 0.3 to 5 μm.

6. Developer comprising the toner for electrophotography according to claim 1 and carrier.

* * * * *